US005924694A

United States Patent [19]

Kent

[11] Patent Number: 5,924,694

[45] Date of Patent: Jul. 20, 1999

[54] BALLISTIC TARGET MATERIAL

[76] Inventor: Howard Daniel Kent, 11635 Gerald Ave., Granada Hills, Calif. 91344

[21] Appl. No.: 08/854,763

[22] Filed: May 12, 1997

[51] Int. Cl.[6] ..... F41J 1/00

[52] U.S. Cl. ..... 273/408; 273/348.1

[58] Field of Search ..... 273/408, 348, 273/348.1, 348.3, 403, 404, 407, 409

[56] References Cited

U.S. PATENT DOCUMENTS 4,695,060 9/1987 Pilgrim ..... 273/404
5,005,841 4/1991 Klick ..... 273/348.3
5,065,032 11/1991 Prosser ..... 273/348.1 X
5,222,741 6/1993 Redl ..... 273/393
5,593,162 1/1997 Minuskin ..... 273/403

*Primary Examiner*—William H. Grieb
*Attorney, Agent, or Firm*—Crockett & Fish; K. David Crockett, Esq.

[57] ABSTRACT

A material for targets including a rubber skin material with an embedded wire skeleton, wherein the wire skeleton comprises a wire screen providing structural support for the rubber skin.

10 Claims, 2 Drawing Sheets

BALLISTIC TARGET MATERIAL

FIELD OF THE INVENTION

This invention relates to ballistic targets and marksmanship targets.

BACKGROUND OF THE INVENTION

Targets are used by marksmen as training aids. Initial firearms training may be performed with traditional bulls-eye targets or paper, plastic or metallic silhouette targets. These targets are useful to train police, soldiers, hunters or other citizens how to aim and shoot. When trying to tactically train police and soldiers who and what to shoot, more sophisticated targets are necessary. In order to train marksmen to differentiate between bad guys and good guys, realistic, three dimensional and variably shaped and dressed targets are very useful. Realistic targets, ones which look like actual human beings, are especially critical in training for real life situations. Police are often faced with the need to differentiate between gun wielding criminals and innocent bystanders in close proximity, as when a bank robber is exiting a bank while bank customers are nearby. Police are also sometimes faced with the need to quickly distinguish between a teenager carrying a pistol and a child carrying a toy gun. Soldiers in modern combat are often faced with fighting situations in which armed enemy soldiers are in close proximity to civilians, and must shoot the enemy soldiers while protecting the civilians. The ability to distinguish between targets and non-combatants is critically important. In a more gruesome scenario, soldiers in the Vietnam war were exposed to grave danger because of their reluctance to shoot women and little children bearing weapons (after having been trained on conventional bulls-eye targets or silhouette targets). In all of these scenarios, training with lifelike targets before the police and soldiers are confronted with the actual real life situation is of great value in ensuring that appropriate target selection can be accomplished under the pressure and confusion of actual criminal or military action.

Targets have been used to simulate real life situations. Styrofoam targets are most common, but these are not very durable and easily fragment after being hit with bullets. Thus they are not re-usable to any great extent. The Styrofoam targets are not deformable or shapable during use, and they must be formed in molds. This limits the number of poses available for simulation purposes, and also requires shipment and storage of mannequins and figures which are large and bulky. Some of these targets may be provided with a balloon suspension system used to signal when the target has been hit. A balloon is inflated inside the chest of the mannequin and suspended from above to hold the mannequin upright. When the chest cavity is struck with a bullet, the balloon bursts and the target falls. To reuse the target, to the extent that it is reusable, the mannequin must be fitted with a new balloon and be re-hung on the range. Thus after each successful hit, a target cannot be re-used without shutting down the range to allow range personnel to rehabilitate the targets. The useful life of these targets is limited by their tendency to crumble or shred under repeated weapons fire, leaving the military and police force with the high cost of frequent replacement.

Other problems are encountered with the mannequin type targets currently in use. Manufacture of the target mannequins involves a high cost of tooling for polymeric targets with injection, blow, spin or other traditional mechanical molding processes. The supply of mannequins, even when dismembered for shipment, involves considerable bulk and storage.

The targets currently in use have unrealistic two dimensional or three dimensional appearance, and permit little variation in positioning, posturing and external visual characteristics. Although the targets sometimes permit the attachment of firearms to the targets, the targets cannot be posed to hold or aim firearms in various positions.

Another technical challenge in target use is determining if the target has been hit. Various layered sheet materials have been proposed which can detect a hit by the changes in the electrical properties of the sheet after the sheet is punctured by a bullet. The sheets have a wire mesh which forms electric circuits which are disrupted by penetration of a bullet through the mesh. Other embodiments use electrically conductive friable (easily crumbled) woven wire screens which indicate a hit when an electric circuit is formed by action of the bullet penetrating a target. The wire mesh used in these target materials is intended to be friable, and there is no indication that the mesh is of sufficient gauge to offer structural support to the target material. In fact, one patent requires that the first screen material be 0.001 to 0.005 inches thick, and that a second wire mesh electrode be 20 mesh flyscreen (window screen).

SUMMARY

Described below is a wire reinforced rubber target material. The target material comprises an elastomeric composite which can form various two and three-dimensional highly durable targets. The elastomeric composite is constructed of a heavy gauge screen and/or fabric embedded within an elastomer, which allows elastomers to penetrate and form a composite material. The elastomeric material is cast or compression molded over the screen and/or fabric to make sheets that can be formed into two or three dimensional targets. The screen and elastomeric materials complement and mutually reinforce each other by their combination and provide reinforcement and structural support to the elastomeric target. Hit verification can be provided with such simple additional layers as paint, or such sophisticated features as a thermal scoring mechanism or an electrically shorting hit verification layer.

DETAILED DESCRIPTION OF THE INVENTION

Figure 1:
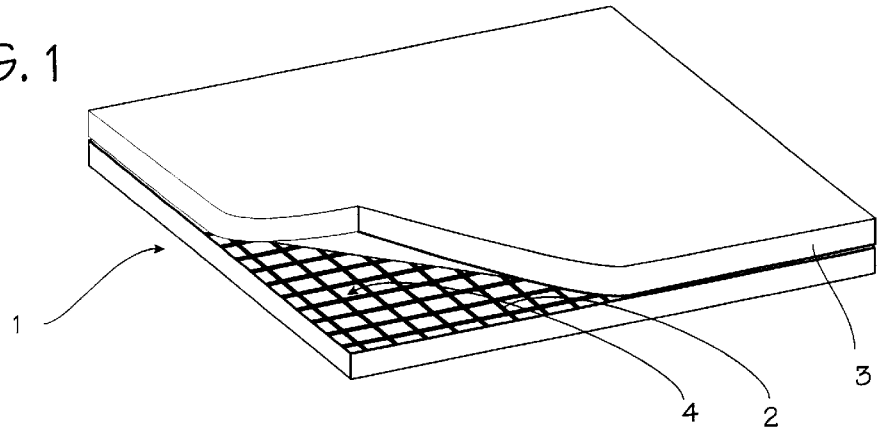
FIG. 1 is a peel-away view of the elastomeric composite.

FIG. 1 shows a peel-away view of the target material 1. In the preferred embodiment, a structural screen 2 is embedded or encased within a sheet 3 which forms a skin over the wire screen.

The screen 2 comprises a heavy gauge woven steel wire screen. The screen must be strong enough to provide structural support to the target material such that the material behaves in a manner similar to plastic deformation, meaning that the material may be bent, folded, and manipulated into new shapes and retain the new shape without returning elastically to the original shape in which they are formed, and that the shape is maintained without substantial support from other structures. The sheet should be formable in the same manner as a twist tie or Gumby® toy. Eighteen gauge steel wire woven into screen works well. The grid size, characterized by the screen holes (or interstices) 4 is optimally larger in diameter than the diameter of the bullet to be used with the target. For example, where a standard 9 mm bullet is used, the screen holes could be at least about 10–12 mm in diameter. This larger hole diameter reduces the likelihood of the bullet hitting several wires of the embedded screen, thus reducing damage to the entire target material. Where the target will be shot with many different bullets, the screen interstices may be made approximately the same size as the caliber of bullets to be shot at the target, and the caliber can be approximated according to the average size bullet used in the intended environment (for police use, pistols are perhaps most commonly used, 9 mm and 0.45 caliber being predominant, and for military use, rifle ammunition of between 5.56 and 7.62 mm is common, so targets can be made with interstices of about 10–15 mm for police target ranges and 7–12 mm for military ranges).

The skin 3 is comprised of a durable rubber, such as a MIL-STD Neoprene-G compound. Alternatively, other durable elastomers or plastics could be use, including silicone. Non-elastomers such as polyethylenes, polyurethanes may also be used. The material chosen for the skin may be light in weight, flexible, and non-friable. When hit by a bullet, the hole created in the skin will substantially close, although it need not reseal itself. The skin thickness of about 0.25 inches when made of Neoprene-G is sufficient to permit closure of bullet holes when used with a wide variety of common bullet sizes, including round nosed pistol bullets such as 9 mm (M-882) bullets, and Spitzer pointed nose bullets such as 5.56 mm (U.S. M-193, 0.224"/3000 fps Spitzer bullets), and 7.62 mm (U.S. M-118, 0.308"/2700 fps Spitzer bullets), and many other bullets. The target material will sustain hundreds of rounds per square foot without compromising its material characteristics, and retaining its self supporting, plastically deformable, and substantially closed surface attributes. The various caliber bullets mentioned above will leave pinholes (about 1 mm or less) in the rubber skin. Depending on the caliber of bullets hitting the target, the wire screen wires may be bent so much by penetrating bullets that the wires penetrate the back of the target material. This does not substantially affect the performance of the target material.

It should be appreciated that a wide variety of materials may be used to fabricate a composite material including suitable skin material and suitable wire material. The wire screen may be made of many materials, and may be constructed as a woven screen, an expanded metal screen, or a grid, and may be made with metal, plastic, carbon fiber or other materials. The combination of rubber skin and steel wire screen, however, works well and is inexpensive. The screen and skin material complement and mutually reinforce each other by their combination and provide reinforcement and structural support to the target material.

Figure 2:
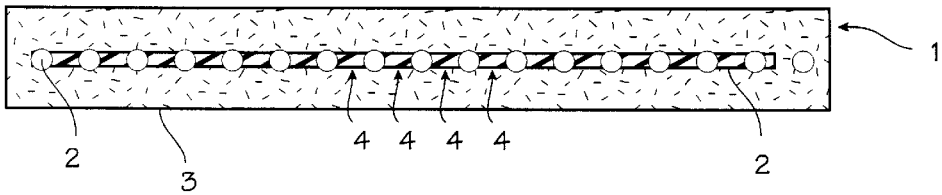
FIG. 2 is a cross-sectional view of the preferred embodiment for the elastomeric composite target material with an embedded wire screen.

As shown in FIG. 2, the elastomeric composite target material 1 is constructed of a heavy gauge wire screen 2 embedded within an elastomer skin 3, which allows the elastomer to penetrate into the interstices of the wire screen and form a composite material. The elastomer 3 is cast or compression molded over the screen 2 to make sheets of the elastomeric composite.

Figure 3:
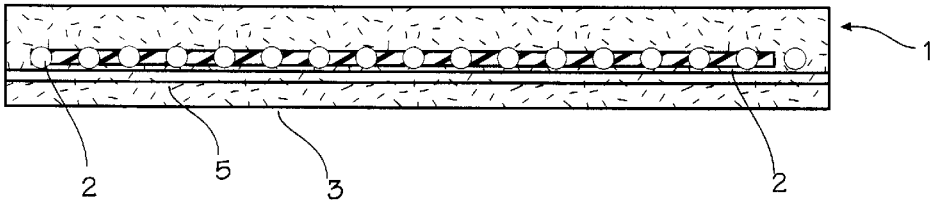
FIG. 3 is a cross-sectional view of a third embodiment for the elastomeric composite with an internal ballistic fabric retention layer.
Figure 4:
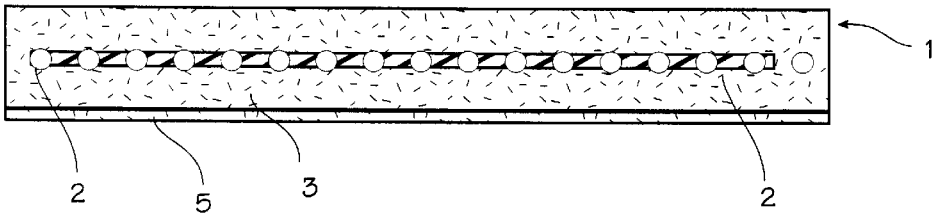
FIG. 4 a cross-sectional view of an embodiment for the elastomeric composite with an external ballistic fabric retention layer.

In another embodiment, a combination of materials can be used to improve durability and reduce fragmentation and wire screen penetration. FIG. 3 shows a cross-sectional view of an elastomeric composite where the screen 2 is first covered with a ballistic fabric 5 (Kevlar, for example) before being embedded in the surrounding elastomer skin 3. The ballistic fabric acts to retain the structural integrity of the screen and prevent the penetrating bullets from forcing severed wires out of the back of the target material. Should any of the wires actually be fragmented by weapons fire, the ballistic fabric will restrain these screen fragments. The prevention of outwardly penetrating screen wires and fragments facilitates handling and disassembly after use. FIG. 4 shows an embodiment in which the ballistic fabric is used in another manner. Here the ballistic fabric layer 5 is disposed on the back side of the target material, and serves to prevent bent wire frame members and fragments from exiting the material.

Figure 5:
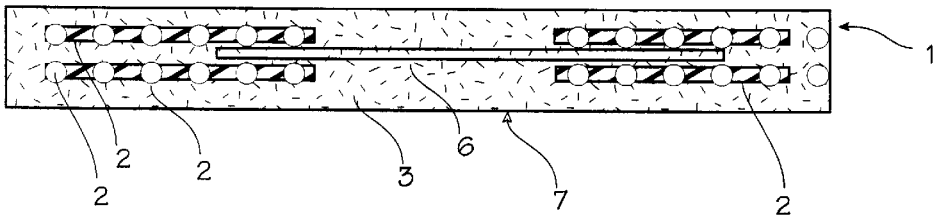
FIG. 5 is a cross-sectional view of an embodiment for the elastomeric composite with fabric in place of the wire screen.

In an alternate embodiment, other materials could be used in place of the heavy gauge woven steel wire screen. Such other materials include screens composed of different metals or durable plastics, metallic foams, non-porous metal sheets, armor plating, fiberglass, ceramic tile, and strong fabric such as DuPont Kevlar®, Allied Signal Spectra® or ballistic nylon. For example, FIG. 5 shows a cross-sectional view of the elastomeric composite composed of a fiberglass fabric and surrounding elastomer. In this embodiment, sufficient wire frame or sheet metal skeletal members 6 may be embedded within the skin material 3 to provide an overall deformability and shape retention to the target material. Fiberglass may be removed in the vicinity of pattern folds 7 and joints to permit deformation into three dimension humanoids or other shapes. This embodiment will be particularly useful as an archery target, and the metal wire has been replaced with fabric to prevent damage to arrowheads. The fabric is sufficiently strong to prevent excessive tearing and damage to the skin material.

Figure 7:
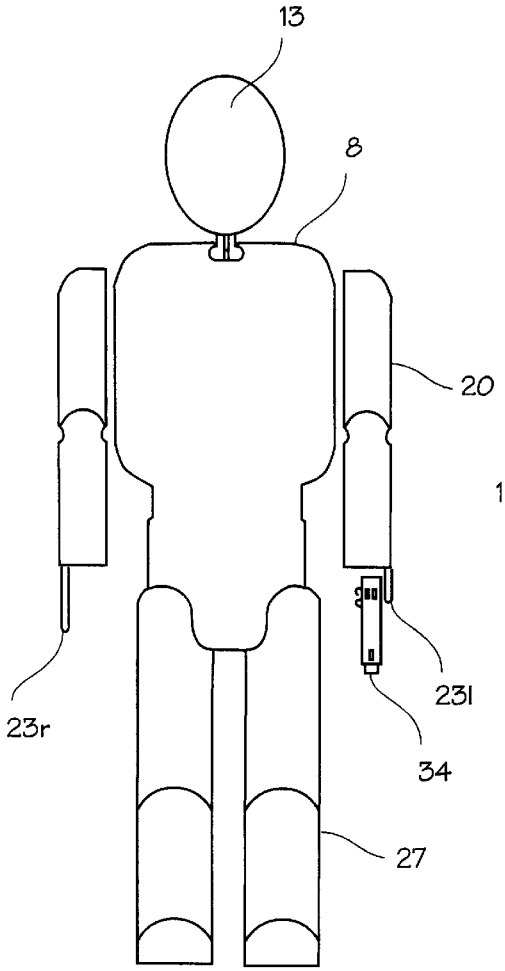
FIG. 7 is an illustration of the assembled humanoid target.
Figure 6:
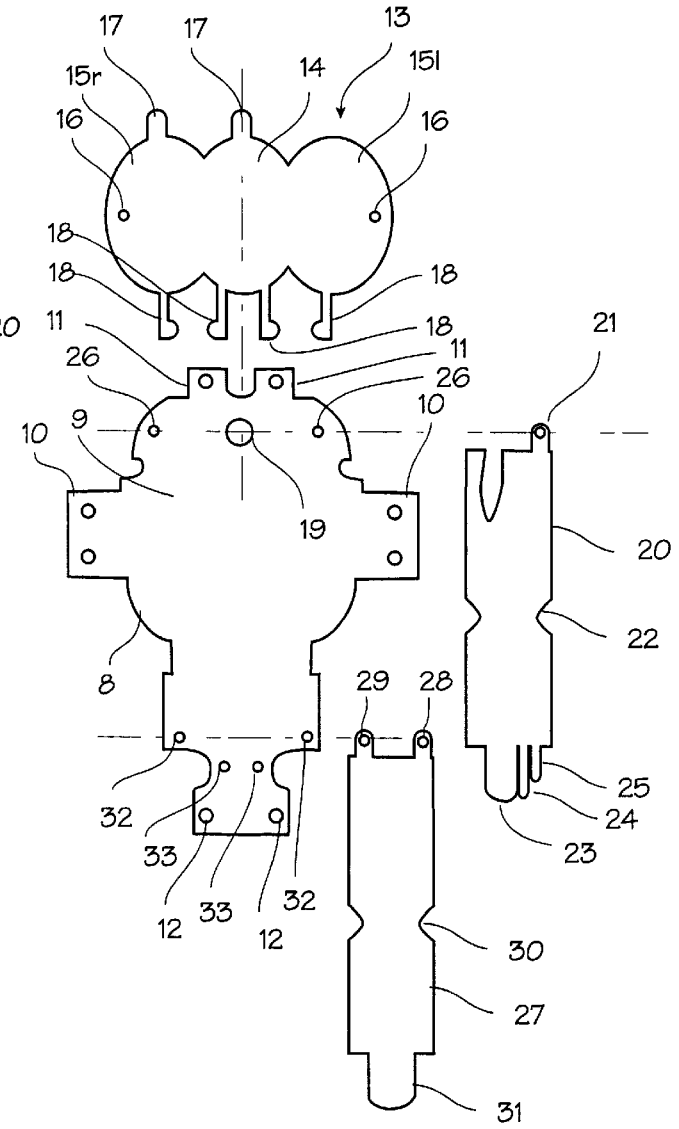
FIG. 6 is a schematic of the target material cut to pattern for assembly into a human shaped target.

In practice, the target material may be provided as two-dimensional sheets which can be formed into two or three-dimensional shapes and used as ballistic targets. FIG. 6 is a pattern for a target which may be folded into the three dimensional humanoid figure shown in FIG. 7. The torso 8 includes a front plate 9 corresponding to the human chest and abdomen. Lateral thoracic tabs 10, shoulder tabs 11, and lumbar tabs 12 may be folded backwards and joined with any convenient fastener (preferably a quick-release fastener, but threaded eye bolts or molley bolts will do). After the corresponding tabs are aligned and fastened, the three dimensional torso will be formed. The head 13 has an anterior surface 14 and left and right lateral surfaces **15*l* and 15*r* which are folded back and joined at the occipatal fastener holes 16, and the parietal tabs 17 at the top of the head are also fastened. Brachial tabs 18 align to create a compressible quick release fitting that is compressed for releasable insertion into the brachial receiving hole 19, providing a snap-on head. The arms 20 are made of sheets of target material having an arm socket tab 21, elbow indents 22, and a hand 23, preferably with a mitten shape with distinct forefinger 24 and thumb 25. The arm sheet is rolled and secured to the torso with fasteners at fastener holes 26. The legs 27 are made of sheets of target material having a hip socket tab 28, and a perineal tab 29, knee indents 30, and a foot 31. The leg sheet is rolled and secured to the torso with fasteners at hip fastener holes 32 and perineal fastener holes 33. In FIG. 7, the assembled humanoid target is shown in a standing position. The material characteristics of the target material may be adjusted so as to allow enough strength in the legs to hold the humanoid target in many postures. Rigid endoskeletal or exoskeletal members may be used to support the target where the target sheet material is not sufficiently rigid. In FIG. 7, the humanoid target hand 23***l* is grasping a gun 34, while the hand 23*r* is empty. The target material described above is sufficiently strong and pliable to permit deformation of the hands and arms into any required shape to hold any desired weapon (pistol, rifle, machine gun, for example) or sundry article (brief case, book, grocery bags, for example). The torso may be twisted to take on prone firing positions and the legs may be bent to take on kneeling firing positions. The targets may be bent into various threatening and non-threatening postures, and the hands and arms may be bent to hold various objects including weapons or sundry articles.

The target may be provided as numerous pattern cut flat sheets, facilitating shipment and storage. The target material may also be provided in flat uncut sheets, and may be cut to pattern by the end user. Note that when the pattern pieces are to be rolled or folded into three dimensional shapes that are secured by fasteners, as is the torso of FIGS. 6 and 7, that the screen may be made of smaller gauge and less strength, as the overall structure will have more strength after assembly. Weight bearing portions, such as the legs and hands may be provided with stronger, stiffer wire screen as necessary to support the weight of the target and strongly grip accessories. The torso sheet 8 and head 13 may have wire screens that are relatively flexible, and serve mainly to prevent excessive destruction of the rubber skin, because much of their structural strength will be provided by the rolling and fastening of assembly. Thus it should appear that portions of the assembled targets may have wire screen that is of insufficient strength to provide substantial structural support without being formed into rolled or folded shapes, yet strong enough to provide for structural integrity of the target material in the face of weapons fire. The targets may be formed in various size human shapes, and may be dressed and accessorized to provide additional realism in a training situation. The targets may also be provided in non-human forms, including animal figures for hunter target training.

Provisions for target "scoring" or hit verification can be included in the design. "Scoring" provides a means for detecting if a bullet or other ammunition has hit the target. The most rudimentary method of scoring is a quick spray coat of contrasting paint. Any bullets hitting the material will remove a small dot of paint, leaving a small dot of bare skin material (the healed bullet hole will be smaller than the dot of paint removed). Neoprene-G is black, so a coat of white paint will lead to the creation of a clearly visible black dot on the target material. The holes will substantially close after penetration, so that the material may be repainted occasionally to make it easy to detect new hits. Other more sophisticated scoring methods may be used. One scoring mechanism uses a heating grid or a heat sensing decal. For example, a heat pattern decal in the shape of the target and comprising an embedded heating grid may be applied to the surface of the target material or may be embedded or integrally formed with the target material. In practice, when a critical part of the target's "body" is hit, the hole left by the hit creates a cold spot on the target. The cold spot will be clearly visible under typical infrared imaging used in military applications. This method of scoring is particularly realistic for training soldiers in targeting enemy troops with infrared imaging equipment. Another method of scoring is the inflated balloon support shown in Redl, U.S. Pat. No. 5,222,741 which may be used in the hollow head or torso of the assembled humanoid target to hold the target to an overhead beam until the balloon is burst by weapons fire.

It should be apparent that the invention may be implemented in many embodiments. The material used for the skin and screen may be varied while still incorporating the invention, and the patterns and shapes of targets may be modified while embodying the invention. Thus, other embodiments and configurations may be devised, and the inventions may be applied in other embodiments without departing from the spirit of the inventions and the scope of the appended claims.

We claim:

1. A target material for use in a target for shooting bullets, said target material comprising a screen embedded within a rubber sheet such that the screen is encased on both sides by the rubber, wherein the screen is of sufficient size and strength that it imparts an overall plastically deformable characteristic to the rubber sheet, and wherein the screen interstices are approximately the same size as the caliber of bullets to be shot at the target.

2. The target material of claim 1 where the screen is composed of a durable steel mesh.

3. The target material of claim 1 where the screen hole diameter is greater than an intended bullet diameter.

4. The target material of claim 1 further comprising a layer of ballistic fabric on at least one side of the rubber sheet.

5. The target material of claim 1 further comprising a layer of ballistic fabric on at least one side of the screen.

6. The target material of claim 1 further comprising a heat pattern decal in the shape of the target and further comprising a heating grid.

7. The target material of claim 1 wherein the target material is pattern cut into flat sheets that may be folded to create a three dimensional target.

8. An elastomeric composite comprising a screen covered with a ballistic fabric and embedded within a durable elastomer such that the fabric covered screen is encased on both sides by the elastomer, wherein the screen is of sufficient size and strength that it imparts an overall plastically deformable characteristic to the elastomeric composite.

9. The elastomeric composite of claim 8 further comprising a heat pattern decal in the shape of the target and further comprising a heating grid.

10. The elastomeric composite of claim 8 wherein the target material is pattern cut into flat sheets that may be folded to create a three dimensional target.

* * * * *